United States Patent [19]

Kohl

[11] 4,192,159

[45] Mar. 11, 1980

[54] APPARATUS FOR THE PRODUCTION OF LOOP PILE WARE ON WARP KNITTING MACHINE

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 903,690

[22] Filed: May 8, 1978

[30] Foreign Application Priority Data

May 17, 1977 [DE] Fed. Rep. of Germany ..... 2722253
Jul. 21, 1977 [DE] Fed. Rep. of Germany ..... 2732968

[51] Int. Cl.[2] ..... D04B 23/00; D04B 27/00
[52] U.S. Cl. ..... 66/203; 66/109
[58] Field of Search ..... 66/203, 109, 104

[56] References Cited

U.S. PATENT DOCUMENTS 2,810,278 10/1957 Noe ..... 66/204
4,055,969 11/1977 Wilkens ..... 66/204

*Primary Examiner*—Ronald Feldbaum
*Attorney, Agent, or Firm*—Omri M. Behr

[57] ABSTRACT

Modifications to a conventional warp knitting machine, which permit the loops on terry cloth towel material to be equal on both sides of the material, include a sinker bar with unequally spaced sinkers that are alternately disposed along the length of the sinker bar. The larger spaces accommodate a plurality of threads while the smaller spaces accommodate a single thread. The invention also permits the use of thicker thread for the pile loop than heretofore.

4 Claims, 5 Drawing Figures

| L1 | | L2 | | L3 | |
|---|---|---|---|---|---|
| 0 | | 5 | | 1 | |
| 0 | | 5 | | 0 | |
| 0 | | 5 | | 0 | |
| 2 | | 0 | | 0 | |
| 3 | | 0 | | 1 | |
| 3 | | 0 | | 1 | |
| 5 | x 2 = I | | x 10 | | x 10 |
| 5 | | | | | |
| 5 | | | | | |
| 2 | | | | | |
| 3 | | | | | |
| 2 | | | | | |
| 0 | | | | | |
| 0 | | | | | |
| 0 | | | | | |
| 2 | | | | | |
| 3 | | | | | |
| 3 | | | | | |
| 6 | | | | | |
| 6 | | | | | |
| 6 | | | | | |
| 3 | | | | | |
| 4 | | | | | |
| 3 | | | | | |
| 1 | x 2 = II | | | | |
| 1 | | | | | |
| 1 | | | | | |
| 3 | | | | | |
| 4 | | | | | |
| 4 | | | | | |
| 6 | | | | | |
| 6 | | | | | |
| 6 | | | | | |
| 3 | | | | | |
| 4 | | | | | |
| 3 | | | | | |

Fig.3

APPARATUS FOR THE PRODUCTION OF LOOP PILE WARE ON WARP KNITTING MACHINE

BACKGROUND OF THE INVENTION

This invention relates to an apparatus for producing terry cloth toweling on warp knitting machines, and in particular to a modification to said machines, which enables equal size loops to be obtained on both sides of the cloth.

Apparatus and methods for producing towel materials, especially terry cloth towels having non-looped transfer stripes, are known to those of ordinary skill in the art. The typical prior art cloth towels all had pile loop threads unequally disposed on either side of the cloth or the ware. Typical of an apparatus for producing terry cloth toweling on a warp machine in U.S. Pat. No. 4,055,969 issued to Wilkens on Nov. 1, 1977. This type of cloth towel was readily accepted by the public since for many years it was the only type of terry cloth towel available. However, it has been the goal of inventors for many years to provide terry cloth towels or wares that contained pile loop material of equal length on both sides of the cloth. Until the novel features as disclosed herein became known, this type of terry cloth material was unobtainable and the thickness of thread utilizable for the loops was limited.

SUMMARY OF THE INVENTION

In accordance with the principles of the present invention, a warp knitting machine for the production of loop pile ware includes an improvement which comprises providing unequally spaced sinkers, the space through which a plurality of threads pass being made larger than the spaces through which the single threads pass. Preferably, the plurality of threads includes at least two members of the group consisting of the pile loop threads, the pillar stitch threads and the weft threads.

These and other features of the present invention will be more fully understood with reference to the following drawings and detailed description of the invention.

BRIEF DESCRIPTION OF THE DRAWINGS

FIG. 3 is a chain pattern table for the guide bars L1, L2 and L3 that provide the pile loops according to the diagram shown in FIG. 2;

DESCRIPTION OF THE PREFERRED EMBODIMENT

In the course of this description, like numbers will be used to indicate like elements according to the different figures illustrated herein.

Figure 1:
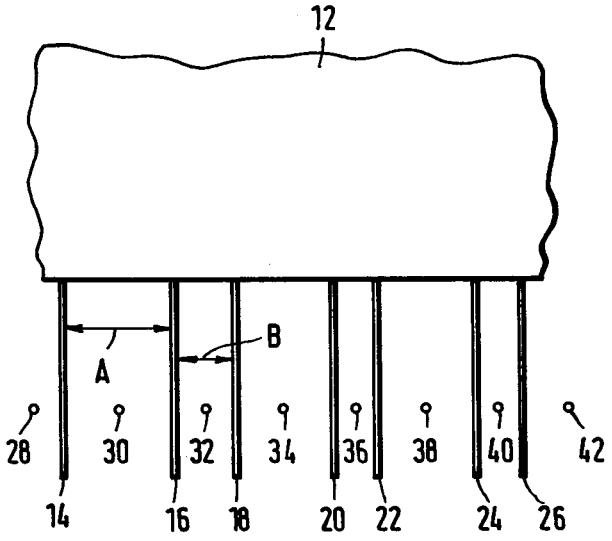
FIG. 1 is a top plan view of a portion of a sinker bar showing the location of the sinkers, in accordance with the principles of the present invention.

Referring now to the figures, and in particular to FIG. 1, which shows a portion of a tricot sinker bar 12 that includes a plurality of unequally spaced sinkers 14, 16, 18, 20, 22, 24 and 26, the sinkers cooperate with a plurality of needles 28, 30, 32, 34, 36, 38 and 40, affixed to a needle bar, not shown. The arrangement of the parts of a warp knitting machine is conventional, and will not be described herein. However, U.S. Pat. No. 4,055,969 issued to Wilkens on Nov. 1, 1977, and U.S. Pat. No. 3,834,193 issued to the same inventor on Sept. 10, 1974, disclose such arrangements. These patents are herein incorporated by reference in their entirety.

Each of the needles have associated therewith a sinker. However, it is to be noted that the spacing between the needles is constant and is the same as that conventionally used. However, the distance A between the sinkers 14 and 16, in the preferred embodiment of the invention, is made larger than the distance B between the sinkers 16 and 18. Also note that the distances A and B are alternately disposed along the length of the sinker bar 12, thus providing additional clearance around needles 30, 34, and 38 when compared to the areas around needles 32, 36 and 40. The function of the additional space caused by the unequally spaced sinkers will be discussed hereinafter.

Terry cloth towel is known in the prior art; however, generally a segment provided with a pile loop alternates with another segment which does not have such a pile loop. In this method of manufacture, the change from one section to the other section is accomplished by the displacement of the appropriate guide bars in accordance with a pre-determined pattern. During this change in the displacement motion of the guide bar, it no longer lays the pile loops over empty needles. The pile loops are then knitted onto the needles knitting the pillar stitch so that a loopless segment of ware is produced. During this step, the associated sinker spaces must accommodate two thread systems, e.g. the threads used for forming the pillar stitch and the threads used for forming the pile loops.

Therefore, a conventional machine which has equally spaced sinkers is restricted to the use of a comparatively small thread diameter since a larger diameter pile loop thread cannot be accommodated with the pillar stitch threads in the conventional spacing between the sinkers.

Two-sided toweling ware is also known in the prior art. Warp knitting machines heretofore known only were able to produce ware with pile loops on one side of the cloth which were substantially smaller than those on the other side. However, in accordance with the principles of the present invention, the spacing between the sinkers utilizing the pillar stitch threads together with the pile loop threads are made wider than the spaces between the sinkers through which threads of only one thread system pass with the distance between the needles in the needle beds unchanged.

Thus, it is now possible to produce terry cloth ware with segments having no pile loops on one side and relatively large pile loop threads on the other. It is also possible to manufacture a two-sided terry cloth material wherein the relatively large diameter pile loops may be equal in length on both sides of the ware.

The space A will preferably be used to accommodate the pillar threads and the pile loop threads, and, as shown, is wider than the space B which will accommodate only a single thread. The size of the spaces A and B will depend upon the gage of the threads to be used. A wider or coarser thread diameter used to form a pile loop will require that the size of gap A be made larger than gap B. The ratio of gap A to B may be as much as 2:1; however, a ratio of approximately 3:2 has been found generally suitable in most applications. It is to be pointed out that the present invention is in no way limited to these specific ratios.

Figure 2:
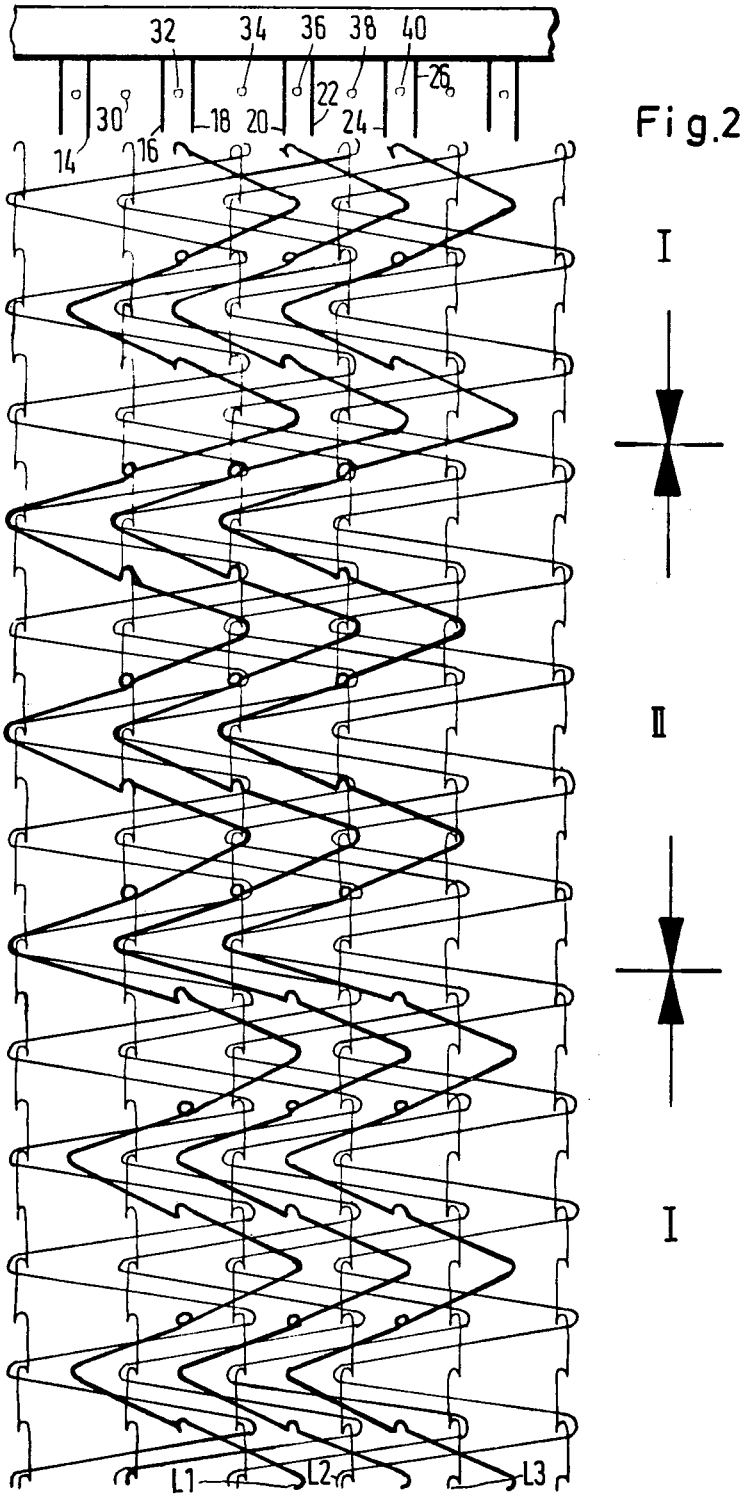
FIG. 2 is a superimposed lapping diagram for producing terry cloth towel materials with pile loops on one side of the ware.

Referring now to FIG. 2 which shows a superimposed lapping diagram for a single-sided terry cloth wherein the pile loops are to be located on only one side of the goods formed by the threads carried by the guide bar L1, not shown, and the stitches are laid about the empty needles. In order to form the pillar stitch guide bars L2 and L3 are utilized in a conventional manner.

L1 refers to the threads carried by the guide bar, not shown, which is normally disposed on the rear of the machine; L2 refers to the thread carried by the guide bar disposed on the middle of the machine; and L3 refers to the threads carried by the guide bar disposed on the front of the machine. Guide bar L1 is used to carry the pile threads, guide bar L2 carries the weft or pile loop threads, and guide bar L3 carries the pillar stitch threads which hold the good together in the direction of the beam. The pile loops are thus formed only on the right-hand side or rear of the ware, that is to say when one stands at the front of the machine on the side away from the viewer.

The drawing (FIG. 2) is divided into two parts, I and II. Part I shows the superimposed lapping which occurs when the carry loops are made on the right-hand side of the ware; and Part II shows the lapping when only smooth ware or no loops are provided. A tricot sinker bar is shown at 12 with the individual sinkers extending in a downwardly direction, similar to that shown in FIG. 1. It is to be noted that on each needle where the pillar stitches are formed larger gaps are provided between the sinkers.

The threads carried by the guide bars L1, L2 and L3 are noted at the lower portion of FIG. 2. FIG. 3 discloses the chain link description for the superimposed lapping diagram shown in FIG. 2. It should be noted that on tricot machines three chains are required for each stitch row. The first chain link controls the swing-in of the guide bar, the second chain link controls the swing-out of the guide bar, and the third chain link is used as an intermediate link in order to be able to smooth out larger jumps, as is well known in the art.

Figure 4:
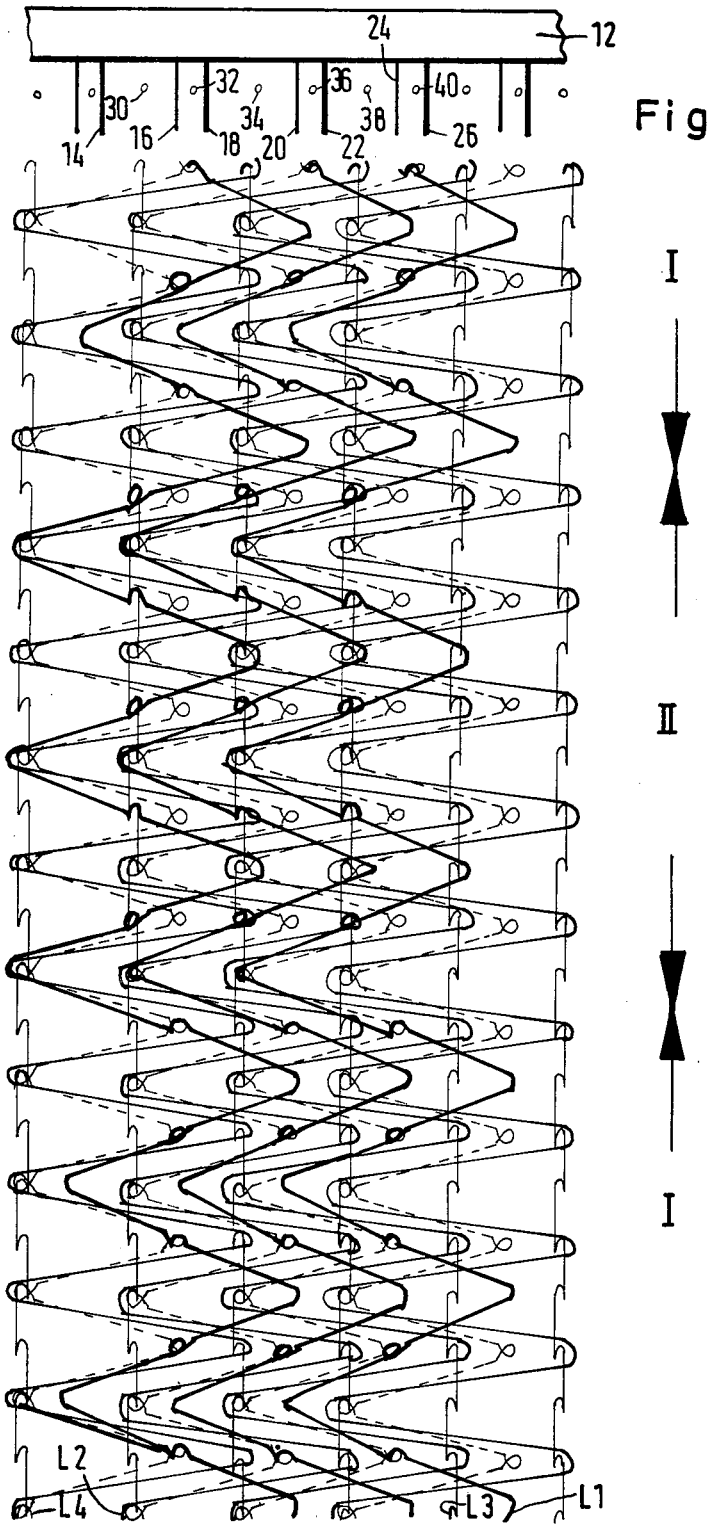
FIG. 4 is a superimposed lapping diagram, according to the principles of the present invention, for producing terry cloth towels with loop pile of equal length on both sides of the cloth or ware.

Similarly, FIG. 4 shows a superimposed lapping diagram for the double-sided loop ware in the manufacture of double-sided loop terry cloth. A guide bar carrying threads L1, not shown, is disposed on the rear side of the machine and is utilized to carry the pile loop threads. A guide bar carrying threads L2, not shown, lies in front of it and forms the weft inlay. A guide bar carrying threads L3, not shown, lies in front of both of the foregoing bars L1 and L2 and contains the pillar stitch thread. A guide bar carrying threads L4, not shown, is the forwardmost guide bar and carries the pile loop threads appearing on the lefthand (front side) of the cloth and is shown in a broken line in FIG. 4. The left side of the ware is that which is facing the viewer of the machine. Here again, I shows that part of the ware wherein the loops are formed and II shows that part of the ware wherein the loops are formed only on the left side of the ware but not on the right side thereof.

The sinker bar 12 with the sinkers 14 through 26 disposed thereon as well as the needles 30 through 40 are the same as shown in FIG. 2. The threads carried by the guide bars L1, L2, L3 and L4 are noted at the lower portion of FIG. 4.

Figure 5:
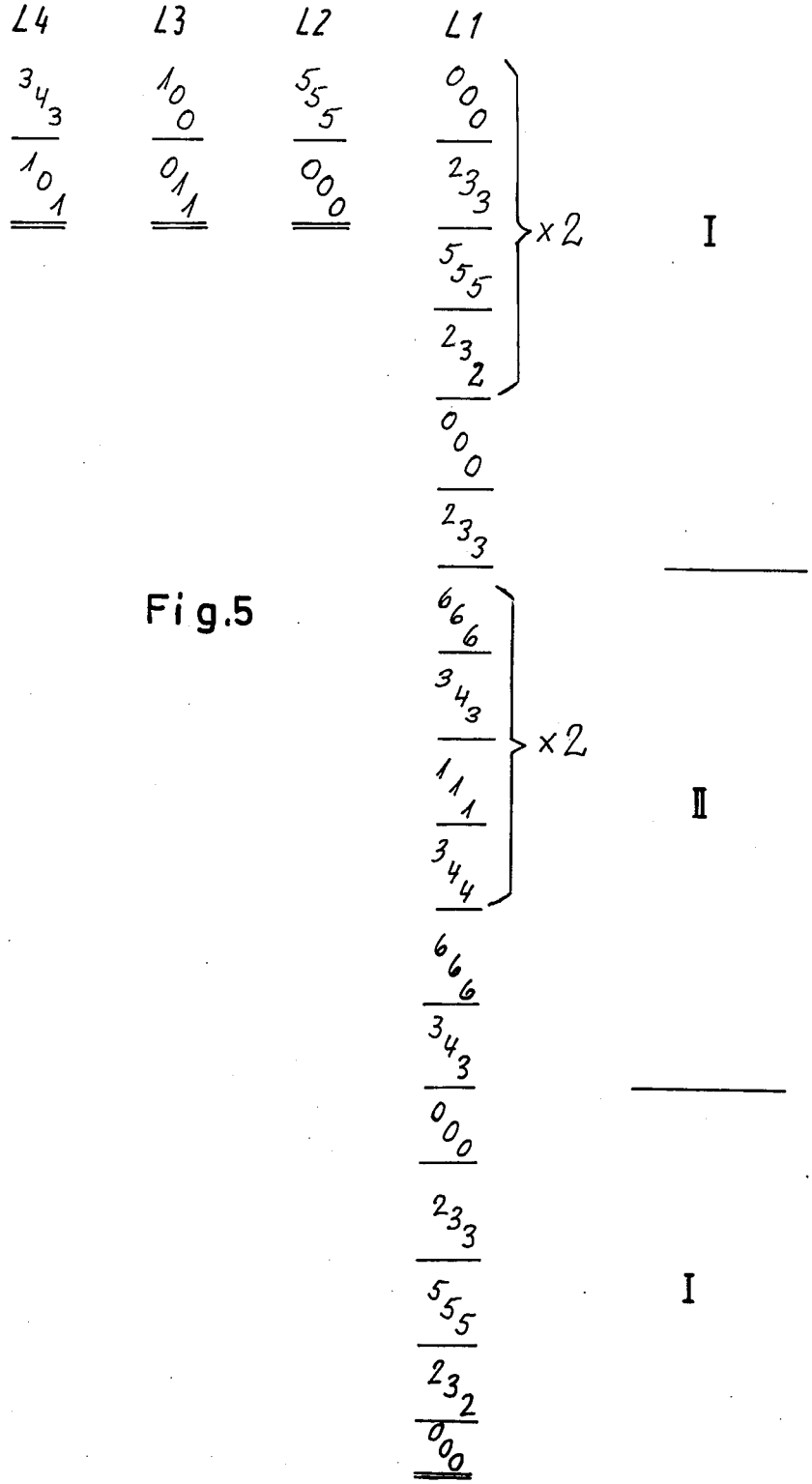
FIG. 5 is a chain pattern table for the guide bars L1, L2, L3 and L4 that provide pile loops on both sides of the ware according to the diagram shown in FIG. 4.

FIG. 5 discloses a chain link description for the foregoing superimposed lapping diagram shown in FIG. 4.

Hereinbefore has been disclosed a means for obtaining terry cloth ware that has relatively large diameter pile loop threads of equal length on either one side of the cloth or equal length pile loops on both sides of the cloth. This has been accomplished by providing equal spacing or gaps between the warp knitting machine needles but utilizing unequally spaced sinkers on the sinker bar.

While the invention has been described with reference to preferred embodiment thereof, it will be appreciated by those of ordinary skill in the art that various different changes or modifications may be made to the elements of the invention without departing from the spirit and scope thereof.

Having thus set forth the nature of the invention, what is claimed is:

1. In a warp knitting machine utilizing a plurality of threads for the production of loop pile ware, said threads being at least pile loop threads, pillar loop threads and weft threads, and having a sinker bar with a plurality of sinkers affixed thereon, said sinkers being unequally spaced on said sinker bar, a larger space passing therethrough a plurality of threads and a smaller space passing therethrough a single thread during stitch formation.

2. In a warp knitting machine according to claim 1 wherein said sinkers are affixed to said sinker bar to provide larger and smaller spaces therebetween said larger and smaller spaces being alternately disposed along the length of said sinker bar.

3. In a warp knitting machine according to claim 2 wherein said larger spaces and said smaller spaces are in a ratio of 3:2.

4. In a warp knitting machine utilizing a plurality of threads for the production of loop pile ware, said threads being at least pile loop threads, pillar loop threads and weft threads and having a sinker bar with a plurality of sinkers affixed thereon, said sinkers providing unequal gaps therebetween along said sinker bar, during stitch formation at least two threads of said pile loop threads, said pillar loop threads and said weft threads passing through the larger of said gaps with the remaining thread passing through the smaller of said gaps.

* * * * *